US009086641B2

(12) United States Patent
Malachowski et al.

(10) Patent No.: US 9,086,641 B2
(45) Date of Patent: Jul. 21, 2015

(54) TONER PARTICLE PROCESSING

(71) Applicant: XEROX CORPORATION, Norwalk, CT (US)

(72) Inventors: Steven M. Malachowski, East Rochester, NY (US); Eric Joseph Young, Webster, NY (US); Jay L. Schneider, Canandaigua, NY (US)

(73) Assignee: XEROX CORPORATION, Norwalk, CT (US)

( * ) Notice: Subject to any disclaimer, the term of this patent is extended or adjusted under 35 U.S.C. 154(b) by 141 days.

(21) Appl. No.: 13/939,911

(22) Filed: Jul. 11, 2013

(65) Prior Publication Data

US 2015/0017585 A1 Jan. 15, 2015

(51) Int. Cl.
*G03G 9/08* (2006.01)
*G03G 9/097* (2006.01)

(52) U.S. Cl.
CPC ..... *G03G 9/0815* (2013.01); *G03G 9/0819* (2013.01); *G03G 9/097* (2013.01); *G03G 9/09708* (2013.01); *G03G 9/09725* (2013.01); *G03G 9/09733* (2013.01)

(58) Field of Classification Search
CPC G03G 9/0804; G03G 9/08755; G03G 9/0806
USPC ..... 430/137.14
See application file for complete search history.

(56) References Cited

U.S. PATENT DOCUMENTS

| | | | | |
|---|---|---|---|---|
| 3,590,000 | A | 6/1971 | Palermoti et al. | |
| 3,655,374 | A | 4/1972 | Palermiti et al. | |
| 3,720,617 | A | 3/1973 | Chatterji et al. | |
| 3,983,045 | A | 9/1976 | Jugle et al. | |
| 4,298,672 | A | 11/1981 | Lu | |
| 4,338,390 | A | 7/1982 | Lu | |
| 5,916,725 | A | 6/1999 | Patel et al. | |
| 6,004,714 | A | 12/1999 | Ciccarelli et al. | |
| 6,063,827 | A | 5/2000 | Sacripante et al. | |
| 6,120,967 | A | 9/2000 | Hopper et al. | |
| 6,190,815 | B1 | 2/2001 | Ciccarelli et al. | |
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 2006/0222991 | A1 | 10/2006 | Sacripante et al. | |
| 2007/0059063 | A1* | 3/2007 | Nakayama et al. | 399/329 |
| 2012/0148948 | A1* | 6/2012 | Ikeda et al. | 430/108.3 |

* cited by examiner

*Primary Examiner* — Hoa V Le
(74) *Attorney, Agent, or Firm* — Pillsbury Winthrop Shaw Pittman LLP

(57) ABSTRACT

A process includes adding a particulate toner additive to toner particles to form a slurry, filtering the slurry to form a filter cake, the particulate toner additive functioning as a filtration aid, and washing the filter cake, after the washing step the toner particles have a portion of the particulate toner additive adhered thereto, and de-agglomerating/drying the toner particles with the additive, after the drying step the toner particles have a portion of the particulate toner additive adhered thereto.

9 Claims, 3 Drawing Sheets

TONER PARTICLE PROCESSING

BACKGROUND

The present disclosure relates to processes for the handling of toner particles. In particular, the present disclosure relates to expanding the function of downstream toner additives to improve cycle time in toner particle handling processes.

In the manufacture of chemical toners, washing is a processing step whereby toner particles are de-watered and washed to meet final quality specifications including, moisture content and removal of residual surfactants and ions. In an exemplary washing process, filter press plates are pressed down tightly against an interweaving filtration cloth creating one or more chambers configured to receive a slurry comprising toner particles. The slurry is fed into the chambers creating a wet filter-cake on the filter cloth while allowing liquids to flow through as a filtrate.

Dynamic washing can also be performed inside the same filter press, by passing wash liquid through the retained particles and then the filter cloth for additional washing as needed. Air drying is then typically performed on the washed cake to meet a desired moisture specification. The dried toner particles can be further processed to manufacture toner compositions comprising toner additives which are typically blended with the toner particles. These additives are designed to provide the toner composition with various properties such as flow control, overall charge, and other desirable characteristics of the toner.

The desirability of using smaller toner particles is it increases the image quality, reduces the amount of toner needed, and can provide potential cost savings in materials. However, one challenge that arises with the use of smaller toner particles is that the filtration cloth may be prone to blinding. Furthermore, smaller toner particles can cause increased cycle times for both filtration and dynamic washing. These effects are due to smaller toner particles decreasing cake porosity and hindering the path of liquids through the toner particle filter cake and filter cloth ultimately reducing washing efficiency and increasing cycle time.

SUMMARY

A process comprising adding a particulate toner additive to toner particles to form a slurry, filtering the slurry to form a filter cake, wherein the particulate toner additive functions as a filtration aid, and washing the filter cake; wherein after the washing step the toner particles have a portion of the particulate toner additive adhered thereto, and de-agglomerating/drying the toner particles with the additive, wherein after the drying step the toner particles have a portion of the particulate toner additive adhered thereto.

A process comprising adding a particulate poly(methyl methacrylate) to toner particles to form a slurry, filtering the slurry to form a filter cake, and washing the filter cake, and drying the filter cake, wherein after the washing and drying steps the toner particles have a portion of the particulate poly(methyl methacrylate) adhered thereto.

A process comprising adding a particulate poly(methyl methacrylate) to super-fine toner particles to form a slurry, filtering the slurry to form a filter cake, washing the filter cake; and drying the toner particles, wherein after the washing and drying steps the super-fine toner particles have a portion of the particulate poly(methyl methacrylate) adhered thereto.

DETAILED DESCRIPTION

Figure 1:
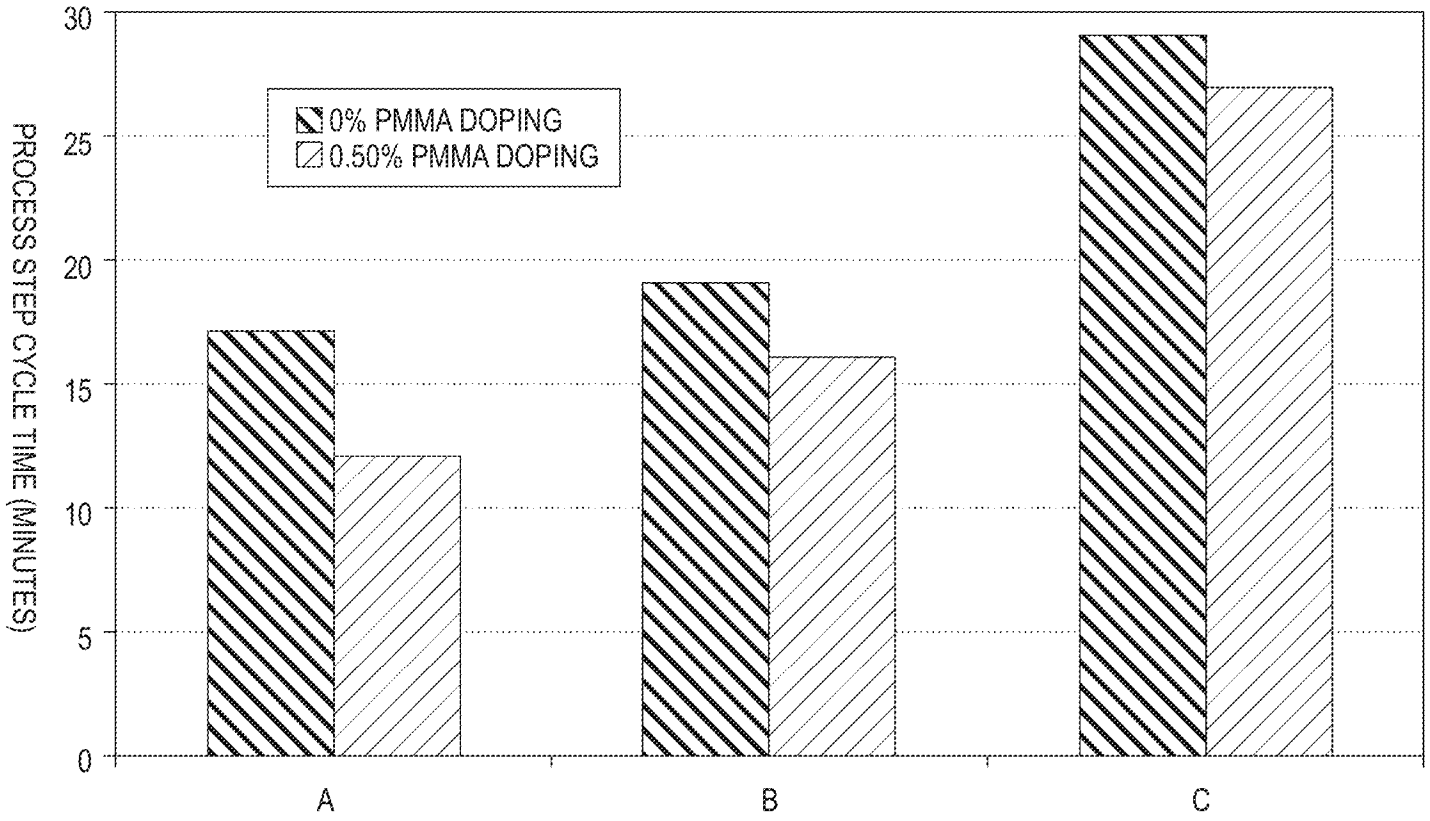
FIG. 1 shows a plot demonstrating the effect of poly(methyl methacrylate) (PMMA) additive doping on slurry transfer times for filtering and dynamic washing.

Embodiments disclosed herein are directed to improved processes for the handling of toner particles, particularly smaller toner particles that may impede toner particle isolation during filtration and washing steps. In accordance with embodiments disclosed herein, toner particle handling may be improved by doping with toner additives prior to filtration and washing, the toner additives acting as a flow aid. In accordance with embodiments disclosed herein, the toner additives may be any additive normally employed downstream as an external additive in preparing toner compositions, with the particular selection of an additive (or additives) being determined by its ability to aid filtration and washing of the toner particles. By way of example, poly(methyl methacrylate) (PMMA additive) can be employed during the filtration and washing steps in toner particle isolation. PMMA, when used as a toner additive, would normally be incorporated during downstream blending processes after filtration and washing steps have been completed.

Without being bound by theory, it is believed that by adding the toner additives during filtration and washing, one can take advantage of the toner additive's fundamental properties to maintain distance between the toner particles providing improved flow and washing efficiency. Advantageously, embodiments disclosed herein may provide (1) a reduction in feed time during mother liquor removal in initial filtration of toner particles; for example, the initial filtration step may occur with about a 30% reduction in feed time; (2) a reduction in feed time for pumping re-slurried material through the filter press; for example, the feed time for pumping re-slurried material may be reduced by about 15%; (3) a reduction in dynamic wash cycle time; for example, the dynamic wash time may be reduced by about 5 to about 10%. Thus, processes disclosed herein may reduce overall cycle times while providing enhanced product quality.

Placing toner additives upstream may provide increased process flexibility. Adding toner additives into a toner slurry before filter pressing and drying processes may provide a means of increasing additive impaction compared to introducing the toner additive during blending processes. Thus, in some embodiments, toner additives used as filtration aids may benefit by adhering to the toner particles and in some such embodiments, such adherence of the toner additive to the toner particle may be better than that achieved in downstream blending processes in the manufacture of toner compositions. Without being bound by theory, the improvement in toner additive attachment to toner particles may be due to the mechanical pressing forces and/or the turbulent energy in the dryer system creating particle to particle collisions in a manner similar to a blending process.

It has been observed that smaller toner particles (less than about 5 microns) can suffer from longer cycle time in filter press washing. Again, without being bound by theory, it has been postulated that during the removal of the mother liquor filtrate, the wet-cake that is produced and subsequently dried is packed closer together due to the small particle size. An initial layer of wet toner cake forms on the filtration media and makes subsequent washing more difficult by choking off the flow compared to the same washing process employing normal particle sizes (greater than about 5 microns). A toner slurry can take longer to feed through the filter cloth during mother liquor removal and during dynamic washing. Dynamic washing can also take longer than it does when using normal toner particle sizes. Thus, in some embodiments, processes disclosed herein may be particularly advantageous when handling smaller toner particles. For example, processes disclosed herein may improve the handling of toner particles having a $D_{50v}$ of about 3.80 microns or less, which may be considered by those skilled in the art as super-fine toner particles. Facilitating use of super-fine toner particles may, in turn, provide cost reduction benefits and material savings such as using less toner mass to produce the same quality image.

Processes disclosed herein include mixing a toner additive into a sieved slurry of toner particles to promote flow and lubrication and to provide spacing for dynamic washing and slurry feeding into the filter press with the benefit of reducing filtration cycle times, improving wash efficiency, and improving toner additive attachment to the toner particles if so desired.

In embodiments, PMMA is an example of a toner additive that may be used for flow and lubrication of the toner particles in filtration and washing. In one such exemplary embodiment, about 1 micron poly(methyl methacrylate) particles can be added to a sieved slurry of toner particles to realize this benefit. Once the toner slurry comprising the toner additive is in the plate chamber of the filter press, it can function as a spacer and effectively increase the filter cake porosity. This increase in porosity provides the desired decreased dewatering time and pressing time required to void out a certain amount of water to achieve a target solids content. Furthermore, the increased porosity may enhance dynamic wash water flow rates and slurry transfer times during mother liquor removal. Without being bound by theory, PMMA or other toner additives may effectively alter the surface chemistry of the toner particles and help contribute to faster washing at least in part due to the hydrophobic nature of the toner additive. The reduced processing time is demonstrated in the Examples below and as shown in the graphs of FIG. 1.

Thus, in some embodiments, there are provided processes comprising adding a particulate toner additive to toner particles to form a slurry, filtering the slurry to form a filter cake, wherein the particulate toner additive functions as a filtration aid, the process further comprising washing the filter cake, wherein after the washing step the toner particles have a portion of the particulate toner additive adhered thereto. As used herein "filter cake" refers to compressed-agglomerated toner particles. The degree of compression-agglomeration, however, does not destroy the integrity of the individual particles. Upon drying, for example, free flowing individual particles may be obtained.

A portion of the particulate toner additive remains adhered to the toner particles even after performing a subsequent drying step. Thus, processes disclosed herein advantageously provide toner additive modified toner particles even before even any downstream blending is performed. As used herein, "adhered" refers to the physically impacted toner additive held on the surface of toner particles. Such adherence may appear as a non-continuous coating of additive particulates distributed about the toner particles. This can be seen in the SEM images provided in connection with the Examples below.

Toner Additives

Suitable particulate toner additives may comprise any additive that is typically blended downstream in the preparation of a toner composition. Such toner additives are typically coated on the surface of the toner particles. In some embodiments the toner additive comprises one selected from the group consisting of an organic spacer particle, a silica, a titania, an alumina, a metal fatty acid salt, a rare earth metal oxide, a charge control agent and combinations thereof. In some embodiments, the toner additive may be one or more additives present in a surface additive package which is normally applied downstream to the toner particles after filtering and washing of the toner particles. Such additives may be designed to adhere (although they may be free flowing) to the external surfaces of the toner particles, rather than being incorporated into the bulk of the toner particles. Such additives may serve to provide superior toner flow properties, high toner charge, charge stability, denser images, and/or lower apparatus contamination.

In some embodiments, the toner additive may comprise one or more silicas, including a silica that has been surface treated with hexamethyldisilazane (HMDS). In some embodiments, the silica may be a sol-gel silica. In some embodiments, the toner additive may comprise a polydimethylsiloxane (PDMS) silica.

In some embodiments, the toner additive employed in processes disclosed herein may include positive or negative charge control agents. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E88™, or zinc salts such as E-84 (Orient Chemical); combinations thereof, and the like.

In some embodiments, the toner additive employed in processes disclosed herein may comprise an organic spacer, such as polymethylmethacrylate (PMMA).

Other toner additives employed during filtering and washing may include, for example, metal salts, metal salts of fatty acids, colloidal silicas, metal oxides, strontium titanates, combinations thereof, and the like. Examples of such additives include, for example, those disclosed in U.S. Pat. Nos. 3,590,000, 3,720,617, 3,655,374, and 3,983,045, the disclosures of each of which are hereby incorporated by reference in their entirety. Other toner additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety.

In particular embodiments, the toner additive may be a fatty acid metal salt which may impart lubricity. Suitable fatty acid metal salts for this purpose may include, without limitation, stearate salts such as zinc stearate, magnesium stearate, or calcium stearate.

In some embodiments, the particulate toner additive may comprise an organic polymer selected from the group consisting of a fluorinated polymer, poly(methyl methacrylate), and a latex.

In some embodiments, the particulate toner additive comprises poly(methyl methacrylate) in an amount in a range of from about 0.50 percent to about 10 percent by weight of the dry particle loading in the slurry. In some embodiments, the amount employed in the slurry may be selected to provide a target coverage of the toner particle after the filtration and washing. For example, if a particular additive adheres such that about 30% of the additive remains on the toner particle at the end of the process, the amount of toner additive employed in the slurry may be adjusted to provide a target coating coverage of the toner particle. In some embodiments, the coverage of a toner additive on a toner particle at the end of filtering and washing processes may be in a range of from about 0 percent of the surface area of the toner particles up to about 5 percent of the surface area of the toner particles.

In some such embodiments, the particulate toner additive may comprise a size, measured as an effective diameter, in a range of from about 0.10 to about 1.50 microns. In some embodiments, where poly(methyl methacrylate) is the toner additive, the particulate PMMA may have an average particle size in a range of from about 0.15 microns to about 1.5 microns. In particular embodiments, PMMA may have an average particle size in a range of from about 0.75 to about 1.25 microns.

Washing

In some embodiments, the washing step of processes disclosed herein may comprise one or more dynamic washings with a wash liquid selected from water, an acid solution, caustic solution, or solvent such as, but not limited to, methanol, or in embodiments, with a wash liquid selected from the group consisting of water, an acid, a caustic, a low ion content water, a reverse osmosis water, a deionized water, a low surface tension water comprising a surfactant. In some embodiments, a wash may be selected to remove certain contaminants while allowing desirable toner additives to remain associated with the toner particles. In some embodiments, the washing step may be carried out by re-suspending the slurry, while in other embodiments the washing step may be performed directly on the filter cake without appreciate re-suspension to a slurry.

Washing may be carried out at a pH of from about 3 to about 12, and in embodiments at a pH of from about 7 to about 11. The washing may be at a temperature of from about 20° C. to about 70° C., in embodiments from about 35° C. to about 50° C. The washing may include filtering and re-slurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes. In embodiments, the particles may be washed about three times with water.

For example, in embodiments, toner particles may be washed in 40° C. deionized water, filtered, re-slurried with HNO3 acid addition, filtered, and re-slurried in fresh deionized water. The washes may continue until the solution conductivity of the filtrate is measured to be low (less than 10 microsiemens per centimeter), which indicates that the ion content is significantly reduced and will not interfere with the metal, in embodiments zinc, treatment.

The washing of the toner particles with the metal ion solution may take place at a temperature of from about 20° C. to about 50° C. The metal ion solution, in embodiments including zinc, is added dropwise to the slurry in an amount of from about 1 to about 120 drops. The metal ion solution is added dropwise to the slurry at a rate of from about 1 drops/min to about 120 drops/min, in embodiments from about 5 drops/min to about 100 drops/min, in embodiments from about 10 drops/min to about 60 drops/min, and mixed for a period of from about 0.5 hours to about 1.5 hours, in embodiments from about 0.75 hours to about 1.25 hours, in embodiments about 1 hour. During this time of mixing, the slurry is slightly heated from about 20° C. to about 60° C., in other embodiments from about 30° C. to about 55° C., in further embodiments from about 35° C. to about 45° C. The zinc attaches to the toner surface in a controlled manner without aggregating the particles together.

In embodiments, the particles may then be subjected to an additional washing step including a metal in solution to enhance their charging characteristics. An increase in the amount of certain metal based charging agents, in embodiments zinc salicylate or other similar agent, on the surface of a toner particle may increase the charging of the toner particles. Thus, in accordance with the present disclosure, a washing step including such a metal may increase the charging of the toner particles.

In particular embodiments, there are provided processes comprising adding a particulate poly(methyl methacrylate) to toner particles to form a slurry, filtering the slurry to form a filter cake, washing the filter cake, wherein after the washing step the toner particles have a portion of the particulate poly (methyl methacrylate) adhered thereto. Even after recovering the modified toner particles after drying a portion of the particulate poly(methyl methacrylate), remains adhered to the toner particles. In some such embodiments, the particulate poly(methyl methacrylate) may be present in an amount in a range of from about 0.50 percent to about 10 percent by weight of the solid loading of the slurry. In some embodiments, the particulate poly(methyl methacrylate) has an average particle size in a range of from about 0.15 microns to about 1.5 microns. In some such embodiments, the toner particles may comprise a volume-median particle size ($D_{50v}$) in a range of from about 3 microns to about 8 microns. In some embodiments, the toner particles comprise a volume-median particle size in a range of from about 3 to about 4 microns.

In some embodiments, there are provided processes comprising adding a particulate poly(methyl methacrylate) to super-fine toner particles to form a slurry, filtering the slurry to form a filter cake, washing the filter cake, wherein after the washing step the super-fine toner particles have a portion of the particulate poly(methyl methacrylate) adhered thereto. In some such embodiments, the particulate poly(methyl methacrylate) is present in an amount in a range of from about 0.50 percent to about 10 percent by weight of the solid loading of the slurry. In some such embodiments, the particulate poly (methyl methacrylate) has an average particle size in a range of from about 0.15 microns to about 1.5 microns. In some embodiments, the super-fine toner particles comprise a volume-median particle size in a range of from about 3 to about 4 microns.

Resins

In some embodiments, the toner particles may comprise at least one resin selected from the group consisting of styrenes, acrylates, methacrylates, butadienes, isoprenes, acrylic acids, methacrylic acids, acrylonitriles, polyesters, and combinations thereof. Any suitable resin employed in the manufacture of toner particles may be employed. The resin composition may comprise one or more resins, such as two or more resins. The total amount of resin in the resin composition can be from about 1% to 99%, such as from about 10% to about 95%, or from about 20% to 90% by weight of the resin composition.

A resin employed as a toner particle as disclosed herein may be any latex resin utilized in forming Emulsion Aggregation (EA) toners. Such resins, in turn, may be made of any suitable monomer. Any monomer employed may be selected depending upon the particular polymer to be used. Two main types of EA methods for making toners are known. First is an EA process that forms acrylate based, e.g., styrene acrylate, toner particles. See, for example, U.S. Pat. No. 6,120,967, incorporated herein by reference in its entirety, as one example of such a process. A second is an EA process that forms polyester, e.g., sulfonated polyester. See, for example, U.S. Pat. No. 5,916,725, incorporated herein by reference in its entirety, as one example of such a process.

Illustrative examples of latex resins or polymers for toner particles include, but are not limited to, styrene acrylates, styrene methacrylates, butadienes, isoprene, acrylonitrile, acrylic acid, methacrylic acid, beta-carboxy ethyl arylate, polyesters, known polymers such as poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methyl methacrylate-isoprene), poly (ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly (styrene-butyl acrylate-methacrylic acid), poly(styrene-butyl acrylate-acrylonitrile), poly(styrene-butyl acrylate-acrylonitrile-acrylic acid), and the like, and mixtures thereof. The resin or polymer can be a styrene/butyl acrylate/carboxylic acid terpolymer. At least one of the resin substantially free of crosslinking and the cross linked resin can comprise carboxylic acid in an amount of from about 0.05 to about 10 weight percent based upon the total weight of the resin substantially free of cross linking or cross linked resin.

The monomers used to access the selected polymer are not limited, and the monomers utilized may include any one or more of, for example, styrene, acrylates such as methacrylates, butylacrylates, β-carboxy ethyl acrylate (β-CEA), etc., butadiene, isoprene, acrylic acid, methacrylic acid, itaconic acid, acrylonitrile, benzenes such as divinylbenzene, etc., and the like. Known chain transfer agents, for example dodecanethiol or carbon tetrabromide, can be utilized to control the molecular weight properties of the polymer. Any suitable method for forming the latex polymer from the monomers may be used without restriction.

In some embodiments, toner particles may comprise a polyester resin such as an amorphous polyester resin, a crystalline polyester resin, and/or a combination thereof. The polymer used to form the resin can be a polyester resin described in U.S. Pat. Nos. 6,593,049 and 6,756,176, the disclosures of each of which are hereby incorporated by reference in their entirety. Suitable resins also include a mixture of an amorphous polyester resin and a crystalline polyester resin as described in U.S. Pat. No. 6,830,860, the disclosure of which is hereby incorporated by reference in its entirety.

The resin can be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfa-1,2-ethanediol, potassio 2-sulfa-1,2-ethanediol, sodio 2-sulfa-1,3-propanediol, lithio 2-sulfa-1,3-propanediol, potassio 2-sulfo-1,3-propanediol, mixture thereof, and the like. The aliphatic diol may be, for example, selected in an amount of from about 40 to about 60 mole percent, such as from about 42 to about 55 mole percent, or from about 45 to about 53 mole percent (although amounts outside of these ranges can be used), and the alkali sulfo-aliphatic diol can be selected in an amount of from about 0 to about 10 mole percent, such as from about 1 to about 4 mole percent of the resin (although amounts outside of these ranges can be used).

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, from about 40 to about 60 mole percent, in embodiments from about 42 to about 52 mole percent, such as from about 45 to about 50 mole percent (although amounts outside of these ranges can be used), and the alkali sulfo-aliphatic diacid can be selected in an amount of from about 1 to about 10 mole percent of the resin (although amounts outside of these ranges can be used).

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly (hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), alkali copoly(5-sulfoisophthaloyl)-copoly(ethylene-adipate), alkali copoly (5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

The crystalline resin can be present, for example, in an amount of from about 5 to about 50 percent by weight of the toner components, such as from about 10 to about 35 percent by weight of the toner components (although amounts outside of these ranges can be used). The crystalline resin can possess various melting points of, for example, from about 30° C. to about 120° C., in embodiments from about 50° C. to about 90° C. (although melting points outside of these ranges can be obtained). The crystalline resin can have a number average molecular weight (Mn), as measured by gel permeation chromatography (GPC) of, for example, from about 1,000 to about 50,000, such as from about 2,000 to about 25,000 (although number average molecular weights outside of these ranges can be obtained), and a weight average molecular weight (Mw) of, for example, from about 2,000 to about 100,000, such as from about 3,000 to about 80,000 (although weight average molecular weights outside of these ranges can be obtained), as determined by Gel Permeation Chromatography using polystyrene standards. The molecular weight distribution (Mw/Mn) of the crystalline resin can be, for example, from about 2 to about 6, in embodiments from about 3 to about 4 (although molecular weight distributions outside of these ranges can be obtained).

Examples of diacids or diesters including vinyl diacids or vinyl diesters used for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester can be present, for example, in an amount from about 40 to about 60 mole percent of the resin, such as from about 42 to about 52 mole percent of the resin, or from about 45 to about 50 mole percent of the resin (although amounts outside of these ranges can be used).

Examples of diols that can be used in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof. The amount of organic diol selected can vary, and can be present, for example, in an amount from about 40 to about 60 mole percent of the resin, such as from about 42 to about 55 mole percent of the resin, or from about 45 to about 53 mole percent of the resin (although amounts outside of these ranges can be used).

Suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be used include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfoisophthalate), copoly propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

An unsaturated amorphous polyester resin can be used as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof. A suitable polyester resin can be a polyalkoxylated bisphenol A-co-terephthalic acid/dodecenylsuccinic acid/trimellitic acid resin, or a polyalkoxylated bisphenol A-co-terephthalic acid/fumaric acid/dodecenylsuccinic acid resin, or a combination thereof.

Suitable crystalline resins that can be used, optionally in combination with an amorphous resin as described above, include those disclosed in U.S. Patent Application Publication No. 2006/0222991, the disclosure of which is hereby incorporated by reference in its entirety. In embodiments, a suitable crystalline resin can include a resin formed of dodecanedioic acid and 1,9-nonanediol. For example, a polyalkoxylated bisphenol A-co-terephthalic acid/dodecenylsuccinic acid/trimellitic acid resin, or a polyalkoxylated bisphenol A-co-terephthalic acid/fumaric acid/dodecenylsuccinic acid resin, or a combination thereof, can be combined with a polydodecanedioic acid-co-1,9-nonanediol crystalline polyester resin.

The resins can have a glass transition temperature of from about 30° C. to about 80° C., such as from about 35° C. to about 70° C. The resins can have a melt viscosity of from about 10 to about 1,000,000 Pa*S at about 130° C., such as from about 20 to about 100,000 Pa*S. One, two, or more toner resins may be used. Where two or more toner resins are used, the toner resins can be in any suitable ratio (e.g., weight ratio) such as, for instance, about 10 percent (first resin)/90 percent (second resin) to about 90 percent (first resin)/10 percent (second resin).

In some embodiments, the toner particles may comprise a volume-median particle size ($D_{50v}$) in a range of from about 3 microns to about 9 microns. In some embodiments, the toner particles may comprise a volume-median particle size in a range of from about 3 to about 4 microns. Processes disclosed herein are not bound by any particular particle size and any size toner particle employed in the art may be used with certain advantages. For example, toner particles less than about 4 microns may experience improved cycle times in filtering and washing via providing improved porosity to the filter cake. Likewise, toner particle larger than about 4 microns may not experience blinding and other negative effects, but the conditions of the filtering, washing, and drying may improve toner additive adherence compared to convention downstream blending processes. Moreover, independent of size, adding one or more toner additives upstream in processing may provide an improved means to provide layered coatings on the toner particles.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

PMMA additive doping studies were conducted on sieved toner particles (3.80 micron average particle size) in a toner slurry. One experiment was run to examine the effect of different levels of additive doping; a second experiment was run to examine the difference between nominal process (no additive addition) and doping process. The slurry was processed through PF 0.40 Larox filter press units; it was washed and dried at nominal processing conditions for 3.8 micron toner particles. Cycle times were monitored closely (feed time during initial mother liquor removal/filtration, feed time for pumping of re-slurried material into the Larox, and RO water dynamic wash cycle time). Dried parent particle was submitted for analysis including scanning electron microscopy (SEM) and PMMA (PYR/GC) analysis.

Procedure: A 20-gallon pilot plant batch of toner particles was created and split into two halves for the purposes of the PMMA doping study; the first half of the batch (part one) received no additive material, and the second half of the batch (part two) was doped with PMMA at the 0.50% level (0.50% of dry particle loading).

PMMA was added to the sieved slurry and allowed to incorporate fully into the slurry for 1.5 hours. The PF 0.40 Larox was used for downstream processing of this material: mother liquor (ML) removal and subsequently dynamic washing (after reslurry washing). Nominal process set-points were used for pilot plant washing: a feed pressure of 1.8 bar, pressing pressure of 2.0 bar, pressing time of 180 seconds for ML removal, pressing time of 90 seconds for dynamic wash, an air drying time of 150 seconds for ML removal, and an air drying time of 200 seconds for dynamic washing.

Process data was collected and validated independently. The results are shown graphically in FIG. 1. Overall, compared to the undoped material, the doped PMMA portion of the toner batch exhibited a 29 percent reduction in cycle time for pumping material feed time during the initial part of the washing process, mother liquor removal. After wash one, re-slurry washing, a pumping feed time reduction of 16 percent was observed. For wash two, dynamic washing, there was a 7 percent reduction in RO-water washing cycle time for the PMMA part of the batch vs. no-PMMA part. In every case, the PMMA-doped material exhibited shorter cycle times as indicated in FIG. 1, with the effect most pronounced for mother liquor separation.

Figure 2A:
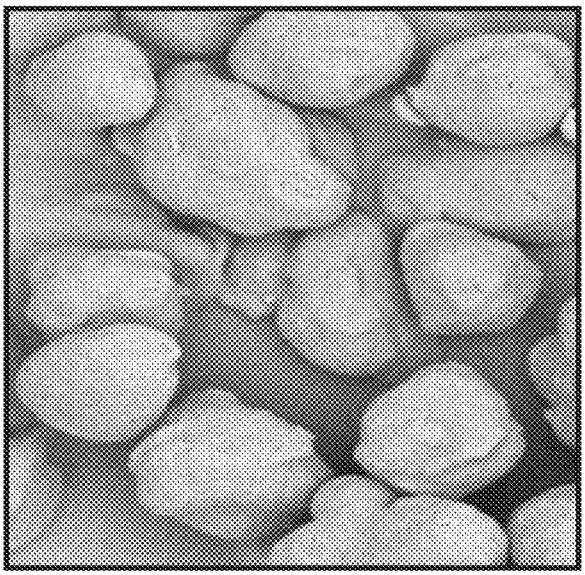
FIGS. 2A and 2B show scanning electron micrograph (SEM) images of dried toner particles ($D_{50v}$=3.80 microns) without (2A) and with (2B) PMMA doping. Magnification=× 6.00 k.
Figure 2B:
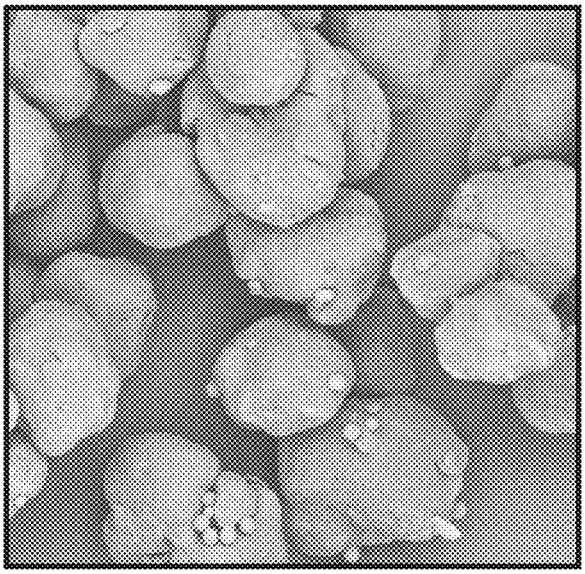

The material was dried super fine parent particles were produced and submitted for analysis. SEM images are shown in FIG. 2. A PMMA analytical test (PYR/GC) revealed that the final amount of PMMA additive loading for the second batch, as a function of dry particle, was about 0.12%. The material was originally doped at a 0.50% level, so this represents approximately a 70% loss of the additive material to filtrate in the washing process during pressing and washing.

The PMMA additive is clearly seen in the SEM image on the right (part 2 of the experiment, PMMA doped portion) as white-colored small spheres attached to the surface of the toner particles. There appears to be a certain distribution of additive impaction produced from pressing in washing and turbulent energy in toroidal flash-jet drying process. Approximately half the PMMA particles are shown attached to the toner; the rest appear to be flattened and to exhibit a greater level of additive impaction into the surface of the toner particles.

Figure 3:
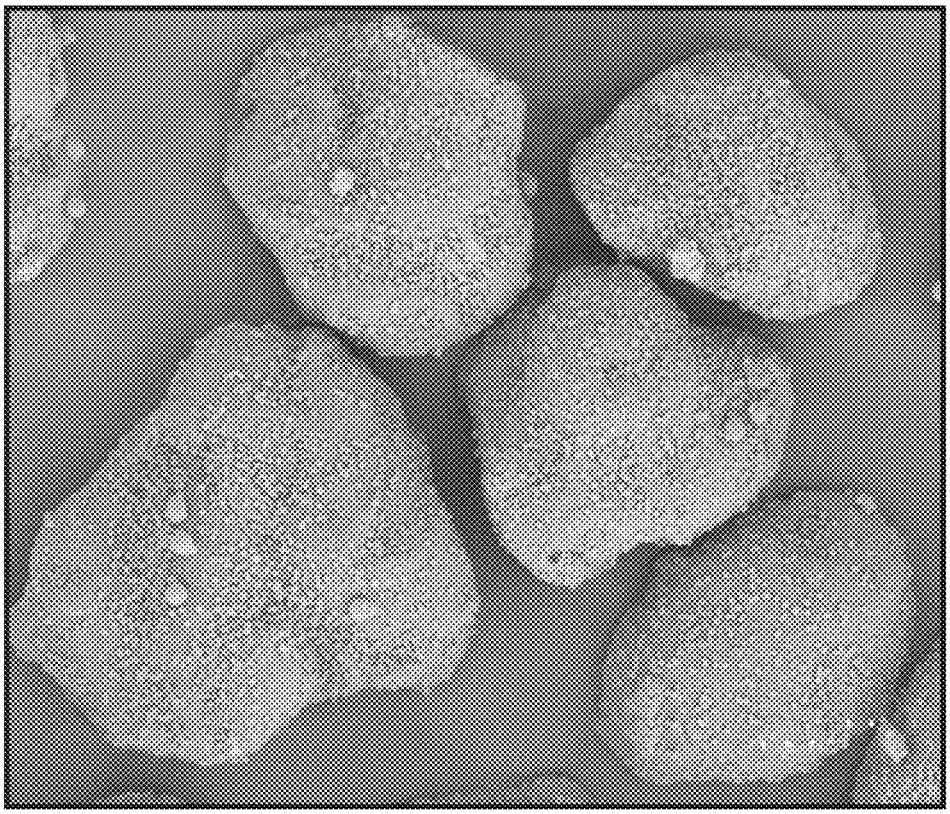
FIG. 3 shows SEM images of dried toner particles ($D_{50v}$=3.8 microns) with PMMA doping. Magnification=× 6.00 k.

As indicated in the SEM images, there is a substantial difference between the undoped material and the PMMA-doped material (the PMMA additive is present on the surface of the toner in the latter). By way of similar processing, a conventional size toner particle ($D_{v50}$=6 micron) is shown in the SEM of FIG. 3. It was evident that PMMA additive attachment during washing and drying was actually higher than that achieved by convention downstream blending. Thus, it appears that additive impaction is better/stronger in the filter press and dryer than in the nominal process of blending.

In summary, toner additives, as exemplified by PMMA, with properties conducive to flow and lubrication may improve the longer cycle times in the washing process observed for small toner particles. Although it was expected that some of the material would be lost in the process, the toner additive that remained was distributed relatively well on the toner particles and demonstrated impaction at least as good, or better, than seen in the nominal blending process. In particular, the present process was demonstrated to be effective in the processing of super fine toner, indicating a reduction in cycle time while also achieving good toner additive impaction into the toner particles. Although PMMA was tested in this Example, one skilled in the art will appreciate the alternative toner additives that can be employed in the processes disclosed herein. Finally, it was shown through the PMMA Example, that the process produced good quality toner particles while exhibiting no substantial negative impact to image quality.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

adding a particulate poly(methyl methacrylate) to toner particles to form a slurry;

filtering the slurry to form a filter cake; and washing the filter cake; and drying the filter cake;

wherein after the washing and drying steps the toner particles have a portion of the particulate poly(methyl methacrylate) adhered thereto.

2. The process of claim 1, wherein the particulate poly (methyl methacrylate) is present in an amount in a range from about 0.1 percent to about 10 percent by weight of the solid loading of the slurry.

3. The process of claim 1, wherein the particulate poly (methyl methacrylate) has an average particle size in a range from about 0.15 microns to about 1.5 microns.

4. The process of claim 1, wherein the toner particles comprise a volume-median particle size ($D_{50v}$) in a range from about 3 microns to about 9 microns.

5. The process of claim 1, wherein the toner particles comprise a volume-median particle size in a range from about 3 to about 4 microns.

6. A process comprising:

adding a particulate poly(methyl methacrylate) to super-fine toner particles to form a slurry;

filtering the slurry to form a filter cake;

washing the filter cake; and drying the toner particles;

wherein after the washing and drying steps the super-fine toner particles have a portion of the particulate poly (methyl methacrylate) adhered thereto.

7. The process of claim 6, wherein the particulate poly (methyl methacrylate) is present in an amount in a range from about 0.1 percent to about 10 percent by weight of the solid loading of the slurry.

8. The process of claim 6, wherein the particulate poly (methyl methacrylate) has an average particle size in a range from about 0.15 microns to about 1.5 microns.

9. The process of claim 6, wherein the super-fine toner particles comprise a volume-median particle size in a range from about 3 to about 4 microns.

* * * * *